US008367593B2

(12) United States Patent
Varadaraj et al.

(10) Patent No.: US 8,367,593 B2
(45) Date of Patent: Feb. 5, 2013

(54) METHOD FOR IMPROVING THE RESISTANCE TO ONE OR MORE OF CORROSION, OXIDATION, SLUDGE AND DEPOSIT FORMATION OF LUBRICATING OIL COMPOSITIONS FOR BIODIESEL FUELED ENGINES

(75) Inventors: Ramesh Varadaraj, Flemington, NJ (US); Jacob J. Habeeb, Westfield, NJ (US); Brandon T. Weldon, Baton Rouge, LA (US); Steven M. Jetter, Hightstown, NJ (US); Steven Kennedy, West Chester, PA (US); William J. Golumbfskie, Media, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 126 days.

(21) Appl. No.: 12/892,570

(22) Filed: Sep. 28, 2010

(65) Prior Publication Data

US 2011/0130316 A1 Jun. 2, 2011

Related U.S. Application Data

(60) Provisional application No. 61/278,227, filed on Oct. 2, 2009.

(51) Int. Cl.
*C10M 133/06* (2006.01)
*C10M 141/00* (2006.01)
*C10L 1/14* (2006.01)

(52) U.S. Cl. ..... 508/545; 508/463; 508/390; 44/307; 44/412

(58) Field of Classification Search ..... 508/545, 508/463, 390; 44/307
See application file for complete search history.

(56) References Cited

U.S. PATENT DOCUMENTS

| | | | | |
|---|---|---|---|---|
| 3,336,124 | A | 8/1967 | Dunworth | |
| 3,595,791 | A | 7/1971 | Cohen | |
| 4,737,159 | A | 4/1988 | Phillips | |
| 5,049,290 | A * | 9/1991 | Emert et al. | 508/270 |
| 6,034,039 | A | 3/2000 | Gomes et al. | |
| 7,179,311 | B2 | 2/2007 | O'Rear et al. | |
| 2004/0152930 | A1 | 8/2004 | O'Rear et al. | |
| 2007/0113467 | A1 | 5/2007 | Abou-Nemeh | |
| 2007/0137098 | A1 | 6/2007 | Martyak et al. | |
| 2007/0151143 | A1 | 7/2007 | Li et al. | |
| 2007/0248740 | A1 | 10/2007 | Sutkowski | |
| 2007/0289203 | A1 | 12/2007 | Deblase et al. | |
| 2008/0127550 | A1 | 6/2008 | Li et al. | |
| 2008/0174323 | A1 | 7/2008 | Raju et al. | |
| 2008/0182768 | A1 | 7/2008 | Devlin et al. | |
| 2008/0282605 | A1 | 11/2008 | Kremer et al. | |
| 2009/0031614 | A1 * | 2/2009 | MacPherson et al. | 44/307 |
| 2009/0111720 | A1 | 4/2009 | Boffa | |
| 2009/0300974 | A1 * | 12/2009 | Burgazli | 44/308 |
| 2010/0064576 | A1 * | 3/2010 | Kormann et al. | 44/388 |

FOREIGN PATENT DOCUMENTS

| | | | |
|---|---|---|---|
| DE | 19622601 | C1 | 3/1998 |
| GB | 1036834 | | 7/1966 |
| WO | 2007115844 | A1 | 10/2007 |
| WO | 2008049822 | A2 | 5/2008 |
| WO | 2008056203 | A2 | 5/2008 |
| WO | 2008121526 | A1 | 10/2008 |
| WO | 2008124390 | A2 | 10/2008 |

OTHER PUBLICATIONS

J. Andrew Waynick, "Evaluation of the Stability, Lubricity, and Cold Flow Properties of Biodiesel Fuel", 6th International Conference on Stability and Handling of Liquid Fuels, Vancouver, B.C., Canada, Oct. 13-17, 1997, pp. 805-829.

* cited by examiner

*Primary Examiner* — Ellen McAvoy
*Assistant Examiner* — Vishal Vasisth
(74) *Attorney, Agent, or Firm* — Robert A. Migliorini

(57) ABSTRACT

Lubricating oil used for the lubrication of engines run on biodiesel fuels are improved in their resistance to oxidation, sludge and deposits formation by the addition to said lubricating oil of detergent to increase the TBN of the lubricating oil or the addition of organic bases.

12 Claims, No Drawings

METHOD FOR IMPROVING THE RESISTANCE TO ONE OR MORE OF CORROSION, OXIDATION, SLUDGE AND DEPOSIT FORMATION OF LUBRICATING OIL COMPOSITIONS FOR BIODIESEL FUELED ENGINES

This application claims benefit of U.S. Provisional Application 61/278, 227 filed Oct. 2, 2009.

BACKGROUND OF THE INVENTION

1. Field of the Invention

The present invention relates to the methods for improving the resistance to one or more of engine corrosion, oxidation, sludge and deposits of lubricating oils for biodiesel fueled engines.

2. Description of the Related Art

Several types of biodiesel fuels have been proposed for as well as introduced into the diesel fuel blend pool for use in commercial and passenger vehicles. The biodiesel fuels would be used as the exclusive fuel or as an addition to hydrocarbon-based diesel fuels. When used as an addition to hydrocarbon-based diesel fuels, the biodiesel fuels constitute anywhere from 2 to 50 wt % of the resulting diesel fuel blends, preferably 5 to 30 wt % of the blend. In Europe biodiesel fuels either are being considered or already have been mandated for use in hydrocarbon-based diesel fuels in an amount in the range of 5 to 10 wt %.

Fuels constituting 100% biodiesel materials are designated B100 while fuels of lesser biodiesel material content are designated in terms of that content, e.g. fuels containing 20% biodiesel component are designated B20. The designation is usually in terms of weight.

Biodiesel fuels are being considered as alternatives to hydrocarbon-based diesel fuels or as diesel fuel blend pool components because of their derivation from renewable plant and animal oils.

Biodiesel fuels are mixtures of lower, short chain esters of mixed saturated and unsaturated straight chain fatty acids derived from vegetable and/or animal fats and oils. The straight chain fatty acids are, typically, $C_{10}$ to $C_{26}$ fatty acids, preferably $C_{12}$ to $C_{22}$ fatty acids. The fatty acids are made into biodiesel by trans-esterification using short chain alcohols; e.g., $C_1$ to $C_5$ alcohols, in the presence of a catalyst such as a strong base.

Vegetable and/or animal oils and fats are natural triglycerides and are renewable sources of starting material. Typical vegetable oils are soybean oil, rapeseed oil, corn oil, jojoba oil, safflower oil, sunflower seed oil, hemp oil, coconut oil, cottonseed oil, sunflower oil, palm oil, canola oil, peanut oil, mustard seed oil, olive oil, spent cooking oil, etc., without limitation. Animal fats and oils include beef, pork, chicken fat, fish oil and oil recovered by the rendering of animal tissue.

Plant source biodiesel fuels are currently the more dominant type in the marketplace. The primary plant sources are soy in North America, rapeseed in Europe, and palm and the other plant source oils elsewhere.

The biodiesel is made by esterifying one or a mixture of such oils and fats using one or a mixture of short chain; e.g., $C_1$ to $C_5$, alcohols, preferably methanol.

Because the most economical trans-esterification processes are performed using methanol, the biodiesel products are identified with reference to the oil or fat source; e.g., soy methyl ester (SME), rapeseed methyl ester (RME), etc.

Trans-esterification is effected by the base catalyzed reaction of the fat and/or oil with the alcohol, direct acid catalyzed esterification of the oil and/or fat with the alcohol, or conversion of the oil and/or fat to fatty acids and then to alkyl esters with alcohol in the presence of an acid catalyst. In base catalyzed trans-esterification, the oil and/or fat is reacted with a short chain alcohol, preferably methanol, in the presence of a catalyst such as sodium hydroxide or potassium hydroxide to produce glycerin and short chain alkyl esters. The glycerin is separated from the product mixture and biodiesel is recovered. Any unreacted alcohol is removed by distillation. The recovered biodiesel is washed to remove residual catalyst or soap and dried.

Because of the natural sources of the oils and/or fats upon which the biodiesel fuels are based, the biodiesel molecules are mixtures of various molecular weights with ester functionality and up to two olefinic double bonds.

The presence of the olefinic double bonds and ester functionality in the biodiesel fuels results in the biodiesel fuels being susceptible to oxidative degradation, resulting in the unsuitability of biodiesel for long term storage.

The ester functionality of the biodiesel fuel is susceptible to decomposition into organic acids by oxidation or even hydrolysis of the biodiesel fuel. This generated acid can catalyze the conjugated diene functionality of the biodiesel ester to oligomeric and polymeric products which are capable of increasing the viscosity of lube oil formulation when, as inevitably will happen, such oligomeric and polymeric products eventually find their way into the lube oil via passage around piston rings and/or exhaust gas circulation equipment which passes exhaust gas into the lube oil circulation system (e.g., PCV valves) and begin to concentrate in the lube oil.

The improvement in the oxidation stability of biodiesel fuel has been the subject of investigation leading to the addition to such fuel of various additives and combinations of additives to effect the desired stabilization.

WO 2008/056203 teaches stabilizer compositions for blends of petroleum and renewable fuels. Mixtures of renewable fuels such as biodiesel, ethanol and biomass mixed with conventional petroleum fuel are stabilized by the addition thereto of a multifunctional additive package which is a combination of one or more additives selected from the group consisting of a free radical chain terminating agent, a peroxide decomposition agent, an acid scavenger, a photochemical stabilizer, a gum dispersant and a metal sequestering agent. Peroxide decomposition agents are selected from the group containing sulfur, nitrogen and phosphorus compounds. Suitable nitrogen-containing compounds are of the general formula:

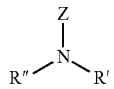

wherein R' and R" can be alkyl linear, branched, saturated or unsaturated $C_1$-$C_{30}$, aromatic, cyclic, poly alkoxy, polycyclic, and Z can be R or:

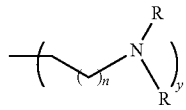

wherein N can be 1-6 and y can be 1-6. Identified as a useful nitrogen-containing compound is N—N-dimethylcyclohexylamine. While N,N-dimethylcyclohexylamine is taught as a useful peroxide decomposition agent, in the examples it is never employed by itself but always in combination with a phenolic anti-oxidant. Reference to FIG. 2 of WO 2008/056203 reveals that whereas the use of the combination of 75% phenol and 25% N,N-dimethylcyclohexylamine (at a treat level of 200 mg/l) resulted in an improvement in the relative stability of the fuel as compared to using 100% phenol over all time periods tested, an increase in the amount of N,N-dimethylcyclohexylamine in the additive mixture to 50% significantly reduced the beneficial effect of the additive mixture (still at a treat level of 200 mg/l) in terms of relative stability over all time periods tested as compared to the 75% phenol/25% N,N-dimethylcyclohexylamine mixture with the most significant reduction in benefit being observed over the long term; i.e., at the six hour time period.

U.S. 2004/0152930 teaches stable blended diesel fuel comprising an olefinic diesel fuel blending stock containing olefins in an amount of 2 to 80 wt %, non-olefins in an amount of 20 to 98 wt % wherein the non-olefins are substantially comprised of paraffins, oxygenates in an amount of at least 0.012 wt % and sulfur in an amount of less than 1 ppm, the blend diesel being stabilized by an effective amount of a sulfur-free anti-oxidant. An effective amount of sulfur-free anti-oxidant is identified as 5 to 500 ppm, preferably 8 to 200 ppm of additive.

The sulfur-free anti-oxidant is selected from the group consisting of phenols, cyclic amines and combinations thereof. Preferably the phenols contain one hydroxyl group and are hindered phenols. The cyclic amine anti-oxidants are amines of the formula:

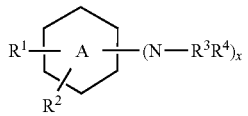

wherein A is a six-membered cycloalkyl or aryl ring, $R^1$, $R^2$, $R^3$ and $R^4$ are independently H or alkyl and X is 1 or 2. An example of the sulfur-free anti-oxidant is given as di-methylcyclohexylamine. See also U.S. Pat. No. 7,179,311.

"Evaluation of the Stability, Lubricity and Cold Flow Properties of Biodiesel Fuel", J. Andrew Waynick, 6$^{th}$ International Conference on Stability and Handling of Liquid Fuel", Vancouver, B. C., Canada, Oct. 13-17, 1997, pages 805-829 addresses various aspects of biodiesel fuel and reports an example where a blend of 80% low sulfur No. 2 diesel fuel/20% methyl soyate ester biodiesel fuel was combined with 20 ppm of the organic base N,N-dimethylcyclohexylamine. At page 813 the report states that "although additive C (the N,N-dimethylcyclohexylamine) did not control hydroperoxide or insolubles formulations, it did hold the TAN to a level near that of the fuel blend with anti-oxidant additive A (N,N-di-sec-butyl-p-phenylenediamine) and B (2,6-di-t-butyl-4-methyl phenol)".

U.S. 2008/0127550 discloses stabilized biodiesel fuel composition wherein the stabilizing agent is a combination of: i) one or more compounds selected from the group consisting of sterically-hindered phenolic anti-oxidants; and ii) one or more compounds selected from the group consisting of triazole metal deactivators.

U.S. 2007/0151143 discloses a stabilized biodiesel wherein the stabilizing additive is selected from one or more of the group consisting of the 3-arylbenzofuranones and the hindered amine light stabilizers and, optionally, one or more hindered phenolic anti-oxidants.

U.S. 2007/0248740 discloses an additive composition comprising 2,5-di-tert-butyl hydroquinone (BHQ), N,N'-disalicylidenepropylenediamine. The additive is used to stabilize fuel containing at least 2% by weight of an oil derived from plant or animal material.

U.S. Pat. No. 3,336,124 discloses stabilized distillate fuel oils and additive compositions for such fuel oils. One additive composition comprises a mixture of: (a) an oil soluble dispersant terpolymer of a particular type; (b) from 0.2 to about 3 parts by weight per part of said oil soluble dispersant tripolymer of N,N-dimethylcyclohexylamine; and (c) a normally liquid inert hydrocarbon carrier solvent in an amount to constitute from about 20% to 80% by weight of the additive composition. See also GB 1,036,384.

WO 2008/124390 discloses a synergistic combination of a hindered phenolic anti-oxidant and a detergent to improve the oxidation stability of biodiesel fuel.

While this reference purports to teach a synergistic mixture of a detergent and a hindered phenol anti-oxidant, the detergent is not any of the metal salt type such as alkali or alkane earth metal sulfonates, phenates, carboxylate or salicylate, but, rather, nitrogen-containing detergents such as hydrocarbyl substituted arylated nitrogen compounds (e.g., polyisobutylene succinic anhydride polyamine, i.e., PIBSA-PAM), hydrocarbyl substituted amines (e.g., polyisobutylene amine), and Mannich base-type detergents which are the reaction products of a hydrocarbyl-substituted phenol, an amine and formaldehyde.

U.S. 2007/0289203 is directed to a synergistic combination of anti-oxidants for biodiesel fuels. The synergistic combination is a mixture of a certain aminic anti-oxidant in combination with a phenolic anti-oxidant. While the optional presence of additional components such as detergents is recited at para. [0038], no specific teaching appears to have been made regarding salicylate or phenates nor to any premixing of the components.

WO 2008/121526 is directed to anti-oxidant blends in biodiesel. The anti-oxidant blend is a combination of: (1) mono- or bis-hindered phenols derived from 2,6-di-tert butylphenol, and (2) N,N"-disubstituted paraphenylene diamine.

U.S. 2007/0113467 is directed to biodiesel fuel of improved oxidation stability comprising biodiesel fuel and at least one anti-oxidant, the anti-oxidant being selected from the specific group recited at paras. [0006] to [0012]. The possible presence of other additives in the biodiesel is mentioned at para. [0052], such other additives including but not being limited to cetane improvers, ignition accelerator agents, metal deactivators, cold flow improvers, etc. Detergents are recited at para. [0065], but are of the PIBSA-PAM and Mannich base variety. No mention is made of alkali or alkaline earth metal salicylates or phenates nor of the desirability that these detergents be of higher TBN.

U.S. 2008/0182768 is directed to a lubricant composition for biodiesel fuel engine applications. The lubricant contains a major amount of a lubricating oil and a minor amount of a highly grafted multifunctional olefin copolymer, the multifunctionality being derived from the presence of amine moiety on the copolymer (para. [0058] to [0071]). The presence of a DI package is mentioned at para. [0085], the detergent including a metal-containing ash-forming detergent, preferably overbased (TBN 150 or greater) which can be sulfonate, phenate, sulfurized phenate, thiophosphonate, salicylate, naphthenate or other oil-soluble carboxylates of alkali or alkaline earth metal. See para. [0086].

"Examples" are mentioned at para. [0123] but there appears to be no mention of any detergents at all being used in the Examples.

U.S. 2008/0127550 stabilizes biodiesel fuel by adding to it an effective amount of a combination of one or more stearically hindered phenols and one or more triazole metal deactivators. No mention appears to be made regarding detergents, but materials such as copper naphthenate, copper acetate, iron naphthenate are disclosed in the Examples.

WO 2008/049822 (abstract) recites that oligo and polyamines having molecular weights from 46 to 70,000 and which are free from phenolic hydroxyl group increase the oxidation stability of biodiesel fuels which are esters of fatty acids.

At page 3 it appears that polyamine-type materials are of the type:

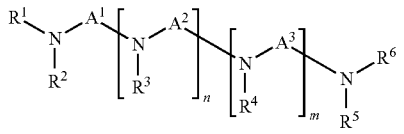

wherein $R^1$ to $R^6$ is a $C_1$ to $C_{30}$ alkyl group, $C_5$ to $C_8$ cycloalkyl group, $C_1$ to $C_{20}$ alkylcarboxyl group or $C_2$ to $C_8$ cyano-alkyl group, $A^1$ to $A^3$ are $C_1$ ($C_2$?) to $C_{12}$ alkylene group and/or $C_6$ to $C_{12}$ arylene group, and n and m are numbers ranging from 0 to 30. (See pages 6 and 7 for more details and specific amine bases.)

The Examples beginning at page 14 show various polyamines compared against BHT in 100 rapeseed oil methylester biodiesel fuel and in 50/50 mix of conventional diesel/biodiesel and reports induction times (oxidation test).

U.S. 2008/0282605 is directed to a method for improving biodiesel fuel by adding strong neutralizing amines to the biodiesel to react with free fatty acid in the fuel that may be left over from the synthesis. This reduces the TAN of the fuel. These strong neutralizing amines may also improve the oxidative stability of the biodiesel fuels.

The strong amines include quaternary ammonium hydroxide and/or quaternary ammonium alkoxide (see paras. [0007] to [0012]).

In para. [0014] it is recited that the use of these amines may have at least two effects: "(1) reducing acid potential as measured by total acid number (TAN) of the biodiesel fuel and/or (2) increasing the oxidative stability of the biodiesel fuel." See Experimental at para. [0039] to [0042] where certain amines are evaluated for TAN control and induction period at 110° C. and the amines are seen to increase the induction period.

U.S. 2008/0182768, published Jul. 31, 2008, filed Jan. 31, 2007 is directed to a lubricant composition for biodiesel fuel engine applications.

The fuel is from 5% to 100% biodiesel. The oil is a major amount of an oil of lubricating viscosity and a minor amount of at least one highly grafted multifunctional olefin copolymer.

The highly grafted multifunctional olefin copolymer is made by reacting an acylating agent with an olefin copolymer to produce an acylated olefin copolymer and reacting the acylated olefin copolymer with an amine to provide the highly grafted multifunctional olefin copolymer.

The use of this copolymer material is effective to reduce viscosity increase in the lubricating oil composition.

The olefin copolymers are copolymers of ethylene and one or more $C_3$ to $C_{23}$ alphaolefins (para. [0012]).

The olefin copolymers are accylated (para. [0024]) and the acylated olefin copolymers are reacted with an aminic compound (para. [0058]) which appear to be aromatic amines (para. [0060] to [0067]).

At para. [0084] it is stated that the lubricating oil can also contain other additives including "detergents" and at para. [0085] such detergents can be overbased and have a TBN of 100 or greater. At para. [0086] the detergents are identified as oil soluble neutral or metal, particularly the alkali or alkaline earth metal overbased sulfonates, phenates, sulfurized phenates, thiophosphonates, salicylates, naphthenates and other oil-soluble carboxylates Included are mixtures of such detergents (para. [0087]). Para. [0123] reports that lubricating oils of the invention were tested in T-11 extended engine tests but what exactly were the additives in the oils tested are not discussed or identified.

DE 19622601, from the abstract, is directed to fuels for diesel engines based on fatty acids and fatty acid esters. The addition of basic nitrogen-containing additives in the form of ammonia, primary or secondary $C_1$ to $C_{20}$ alkylamines or $C_2$ to $C_8$ amineoalcohols is mentioned.

WO 2007/115844 teaches a method for increasing the oxidation stability of biodiesel fuels. An anti-aging additive is used having the formula:

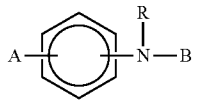

wherein A, R and B are defined in the abstract. Basic amine materials are disclosed as useful for improving the oxidation stability of biodiesel. The text contains Examples (Example 3) of improved oxidation stability achieved using various basic amine compounds as taught in the application.

U.S. 2007/0248740 is directed to a liquid composition comprising a major amount of an oil and a minor amount of an additive composition comprising a synergistic mixture of BHQ and N,N'-disalicylidine propylene diamine and wherein at least 2 wt % of the oil is derived from a plant or animal material.

The additive retards oxidation in the liquid composition. It appears that the "at least 2 wt % of the oil (which) is derived from a plant or animal material" refers to biodiesel fuel present in the lubricating oil [paras. [0024] to [0030]).

U.S. 2007/0289203 is directed to a synergistic combination of anti-oxidants for biofuels. The synergistic mixture of anti-oxidants comprises at least one sterically hindered phenol and at least one aromatic diamine. The aromatic diamines are tested at paras. [0022] to [0026]. Examples are presented at paras. [0041] to [0048].

U.S. 2007/0137098 teaches that compositions containing unsaturated fatty ester (biodiesel) may be stabilized against oxidation by the addition of an anti-oxidant package containing a phenolic anti-oxidant and a non-phenolic oxygen scavenger such as hydroxylamine, amine N-oxide, oxime or nitrone. The amine-N-oxide can be used without the phenolic anti-oxidant.

DESCRIPTION OF THE INVENTION

Lubricating oils used to lubricate engines run on biodiesel fuels are stabilized against oxidation and/or sludge and/or deposit formation and engines lubricated with such lubes are protected against corrosion by addition to the lubricating oils or to the biodiesel fuels of an additive amount of a premix comprising one or more organic bases, one or more detergents and one or more anti-oxidants. Biodiesel fuels are also stabilized against oxidation by the addition to the biodiesel fuels of an additive amount of a premix comprising one or more organic bases, one or more detergents and one or more anti-oxidants.

The organic bases include nitrogen-containing bases as exemplified by the formula:

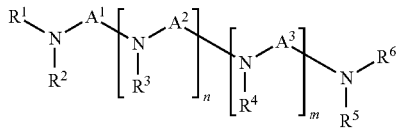

wherein $R^1$ to $R^6$ is a H. $C_1$ to $C_{30}$ alkyl group, $C_5$ to $C_8$ cycloalkyl group, $C_1$ to $C_{20}$ alkylcarboxyl group or $C_2$ to $C_8$ cyano-alkyl group, $A^1$ to $A^3$ are $C_2$ to $C_{12}$ alkylene group and/or $C_6$ to $C_{12}$ arylene group, and n and m are numbers ranging from 0 to 30.

Organic bases include tetraethylene penta amine (TEPA), diethylene tri-amine, triethylene tetra-amine, penta ethylene hexa-amine, tetrapropylene penta-amine, dipropylene tri-amine, tripropylene tetra-amine, pentapropylene hexa-amine, etc.

Organic bases also include materials wherein primary amines are attached to tertiary carbon atoms such as:

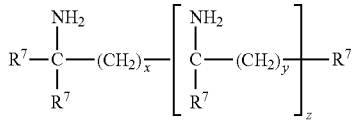

wherein $R^7$ are the same or different on each molecule and are selected from $C_1$ to $C_{10}$ alkyl, $C_5$ to $C_{10}$ cycloalkyl, $C_6$ to $C_{10}$ aryl, $C_7$ to $C_{10}$ aryl alkyl, $C_7$ to $C_{10}$ alkylaryl and x is an integer from 0 to 20, y is an integer from 0 to 20 and z is an integer from 0 to 20.

Other useful organic bases include materials such as:

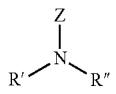

wherein R' and R" are the same or different $C_1$ to $C_{30}$ alkyl, $C_3$ to $C_{30}$ branched, $C_3$ to $C_{30}$ unsaturated alkyl, $C_6$ to $C_{30}$ aryl, $C_7$ to $C_{30}$ arylalkyl, $C_7$ to $C_{20}$ alkylaryl, $C_5$ to $C_{30}$ cycloalkyl or polycycloalkyl, $C_5$ to $C_{30}$ poly alkyl; and Z can be the following structure:

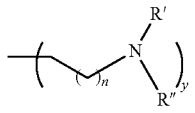

wherein N can be 1-6 and y can be 1-6.

The detergents are selected from the group consisting of alkali, alkaline earth metal or hydrocarbyl-substituted salicylates, phenates, sulfonates, stearates, naphthanates, carboxylates and mixtures thereof.

They have a TBN of at least 20, preferably at least 150, more preferably at least 250, still more preferably at least 300.

Mixtures of phenate, sulfonate, salicylate and carboxylate can be employed, preferably the calcium salts of such materials. They can be used in a ratio of phenate:sulfonate:salicylate:carboxylate in the range 1:1:1:1, preferably 1:1:1:0, more preferably 1:0:1:0, most preferably 0:0:1:0, the zero in the ratios indicating the absence of a component.

A typical detergent is an anionic material that contains a long chain oleophillic portion of the molecule and a smaller anionic or oleophobic portion of the molecule. The anionic portion of the detergent is typically derived from an organic acid such as a sulfur acid, carboxylic acid, phosphorus acid, phenol, or mixtures thereof. The counter ion is typically an alkaline earth, alkali metal or hydrocarbyl substituent.

Salts that contain a substantially stoichiometric amount of the metal are described as neutral salts and have a total base number (TBN, as measured by ASTM D2896) of from 0 to 80. Many compositions are over based, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention. Preferred detergents include the alkali or alkaline earth metal salts of sulfates, phenates, carboxylates, phosphates, and salicylates. Preferably in the present invention the detergent is overbased, having a TBN of at least 150, preferably at least 200, more preferably at least 250, still more preferably at least 300. Hydrocarbyl substituents are preferably selected from $C_1$-$C_{20}$ alkyl, $C_4$-$C_{20}$ branched alkyl, $C_6$-$C_{20}$ aryl, $C_7$-$C_{20}$ aryl alkyl, $C_7$-$C_{20}$ alkyl aryl which may be heteroatom, i.e. sulfur, oxygen or nitrogen, substituted either in the carbon skeleton or by heteroatom-containing substituent groups, preferably $C_1$-$C_{20}$ alkyl, $C_4$-$C_{20}$ branched alkyl, $C_6$-$C_{20}$ aryl, $C_7$-$C_{20}$ aryl alkyl, $C_7$-$C_{20}$ alkyl aryl which may be heteroatom, i.e. sulfur, oxygen or nitrogen substituted, preferably nitrogen substituted, in either the carbon skeleton or by heteroatom-containing substituent groups, preferably the hydrocarbyl substituent is an alkyl amine, more preferably a $C_1$-$C_{20}$ alkyl amine, still more preferably a $C_6$-$C_{12}$ alkyl amine. An example of a useful hydrocarbyl substituent is PRIMENE 81R®, which is a $C_{12}$ primary amine where the nitrogen is attached to a tertiary carbon atom.

Sulfonates may be prepared from sulfonic acids that are typically obtained by sulfonation of alkyl substituted aromatic hydrocarbons. Hydrocarbon examples include those obtained by alkylating benzene, toluene, xylenes, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Klamann in *Lubricants and Related Products*, Verlag Chemie, Deerfield Beach, Fla.; ISBN 0-89573-177-0, discloses a number of overbased metal salts of various sulfonic acids which are useful as detergents and dispersants in lubricants. The book entitled "*Lubricant Additives*", C. V. Smallheer and R. K. Smith, published by the Lezius-Hiles Co. of Cleveland, Ohio (1967) similarly discloses a number of overbased sulfonates which are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably $C_4$-$C_{20}$. Examples of suitable phenols include isobutylphenol, 2-ethylhexylphenol, nonylphenol, 1-ethyldecylphenol and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates, where alkyl groups have 1 to about 30 carbon atoms, with 1 to 4 alkyl groups per benzenoid nucleus, and with the metal of the compound including alkaline earth metal. Preferred alkyl chains are of at least $C_{11}$, preferably $C_{13}$ or greater. Such alkyl groups may be optionally substituted with substituents that do not interfere with the detergent's function. The metal is preferably calcium, magnesium or barium, more preferably calcium.

Hydrocarbyl-substituted salicylic acids may be prepared from phenols by the Kolbe reaction. See U.S. Pat. No. 3,595,791 for additional information on synthesis of these compounds. The metal salts of the hydrocarbyl-substituted salicylic acids may be prepared by double decomposition of a metal salt in a polar solvent such as water or alcohol. Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039, for example.

Preferred detergents include calcium phenates, calcium sulfonates, calcium salicylates, magnesium phenates, magnesium sulfonates, magnesium salicylates and other related components (including borated detergents). More preferably the detergents are the calcium detergents.

The premixed employed in the present invention also contains one or more anti-oxidants including phenolic anti-oxidants, aminic anti-oxidants as well as oil soluble metal complex anti-oxidants.

The phenols include sulfurized and non-sulfurized phenolic anti-antioxidants. The terms "phenolic type" or "phenolic anti-oxidant" used herein include compounds having one or more than one hydroxyl group bond to an aromatic ring which may itself be mononuclear; e.g., benzyl, or polynuclear; e.g., naphthyl and spiro aromatic compounds. Thus, "phenol type" includes phenol per se, catechol, resorcinol, hydroquinone, naphthol, etc., as well as alkyl or alkenyl and sulfurized alkyl or alkenyl derivatives thereof, and bisphenol-type compounds including such bi-phenol compounds linked by alkylene bridges, sulfur bridges or oxygen bridges. Alkyl phenols include mono- and poly-alkyl or alkenyl phenols, the alkyl or alkenyl group containing from about 3-100 carbons, preferably 4-50 carbons and sulfurized derivatives thereof, the number of alkyl or alkenyl groups present on the aromatic ring ranging from 1 to up to the available unsatisfied valences of the aromatic ring remaining after counting the number of hydroxyl groups bound to the aromatic ring.

Generally, therefore, the phenolic anti-oxidant may be represented by the general formula:

$$(R^A)_x\text{—Ar—}(OH)_y$$

where Ar is selected from the group consisting of:

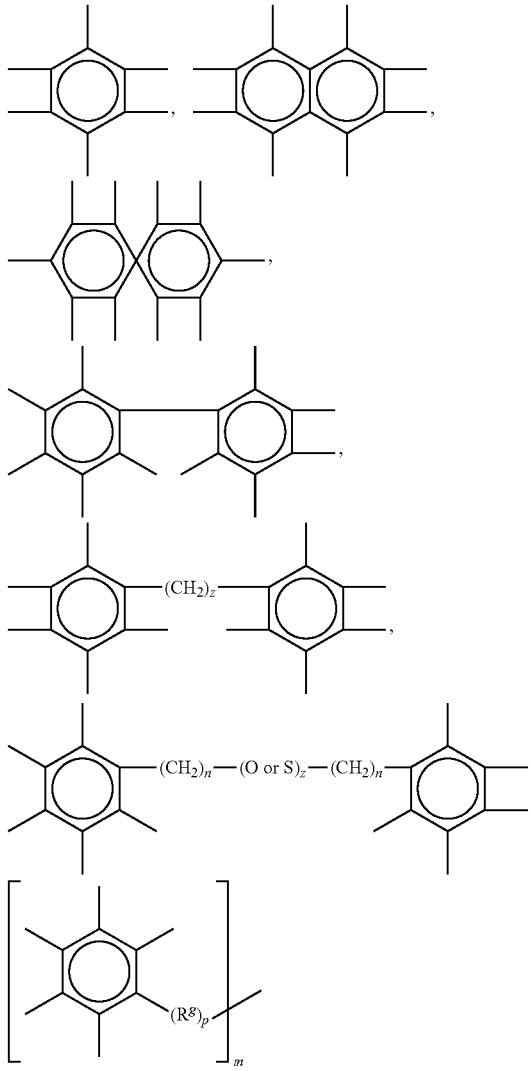

wherein $R^A$ is a hydrogen or a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, Rg is a $C_1$-$C_{100}$ alkylene or sulfur substituted alkylene group, preferably a $C_{20}$-$C_{50}$ alkylene or sulfur substituted alkylene group, more preferably a $C_2$-$C_{20}$ alkylene or sulfur substituted alkylene group, y is at least 1 to up to the available valences of Ar, x ranges from 0 to up to the available valences of Ar-y, z ranges from 1 to 10, n ranges from 0 to 20, and m is 1 to 5 and p is 1 or 2, preferably y ranges from 1 to 3, x ranges from 0 to 3, z ranges from 1 to 4 and n ranges from 0 to 5, and p is 1.

Preferred phenolic anti-oxidant compounds are hindered phenolics which contain a sterically hindered hydroxyl group, and these include those derivatives of dihydroxy aryl compounds in which the hydroxyl groups are in the o- or p-position to each other. Typical phenolic anti-oxidants include the hindered phenols substituted with $C_1$+ alkyl groups and the alkylene sulfur bridge or oxygen bridge coupled derivatives of these hindered phenols. Examples of phenolic materials of this type include 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol, 2,6-di-t-butyl-4-methyl phenol; 2,6-di-t-butyl-4-ethyl phenol; and 2,6-di-t-butyl-4-alkoxy phenol. Other useful hindered mono-phenolic anti-oxidants may include, for example, hindered 2,6-di-alkyl-phenolic proprionic ester derivatives. Bis-phenolic anti-oxidants may also be advantageously used in combination with the instant invention. Examples of ortho-coupled bis-phenols include: 2,2"bis(6-t-butyl-4-heptyl phenol); 2,2"-bis(6-t-butyl-4-octyl phenol); and 2,2"-bis(6-t-butyl-4-dodecyl phenol). Para-coupled bis-phenols include, for example, 4,4'-bis(2,6-di-t-butyl phenol) and 4,4"-methylene-bis(2,6-di-t-butyl phenol).

Phenolic-type anti-oxidants are well known in the lubricating industry and commercial examples such as ETHANOX® 4710, IRGANOX® 1076, IRGANOX® L1035, IRGANOX® 1010, IRGANOX® L109, IRGANOX® L118, IRGANOX® L135 and the like are familiar to those skilled in the art. The above is presented only by way of exemplification, not limitation on the type of phenolic anti-oxidants which can be used in the present invention.

Aromatic amine compound anti-oxidants include alkylated or non-alkylated aromatic amines such as aromatic monoamine of the formula:

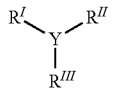

where $R^I$ is an aliphatic, aromatic or substituted aromatic group, $R^{II}$ is an aromatic or a substituted aromatic group and $R^{III}$ is hydrogen, alkyl, aryl or $R^{IV}S(O)nR^V$, wherein $R^{IV}$ is alkylene, alkenylene or arylalkylene group and $R^V$ is a higher alkyl group, or an alkenyl, aryl or alkaryl group and n is 0, 1 or 2. When $R^I$ is an aliphatic group it may contain from 1 to about 20 carbon atoms, and preferably contains from about 6 to 12 carbon atoms. The aliphatic group is a saturated aliphatic group. Preferably both $R^I$ and $R^{II}$ are aromatic or substituted aromatic group and the aromatic group may be a single ring or fused multi-ring aromatic group such as naphthyl aromatic group. $R^I$ and $R^{II}$ may be joined together with other groups such as sulfur. $R^{III}$ is preferably hydrogen.

Typical aromatic amine anti-oxidants are diphenyl amine and phenyl naphthylamine, wherein the phenyl and/or naphthyl group(s) has (have) alkyl substituted group(s) of at least about 6 carbon atoms.

Examples of aliphatic groups include hexyl, heptyl, octyl, nonyl and decyl. Generally the aliphatic groups will not contain more than about 14 carbon atoms. The general types of amine anti-oxidants useful in the present compositions include diphenylamines, phenyl naphthylamines, phenothiazines, imidodibenzyls and diphenyl phenylene diamines. Mixtures of two or more aromatic amines are also useful. Polymeric amine anti-oxidants can also be used. Particular examples of aromatic amine anti-oxidants useful in the present invention include: p,p'-dioctyldiphenylamine; t-octylphenyl-alpha-naphthylamine; phenyl-alphanaphthylamine; and p-octyl-alpha-naphthylamine.

Oil soluble organometallic compounds and/or oil soluble organometallic coordination complexes suitable for use as an anti-oxidant in the present invention are materials selected from the group consisting of:

(a) one or more metal(s) or metal cation(s) having more than one oxidation state above the ground state, excluding iron and nickel, complexed, bonded or associated with two or more anions;

(b) one or more metal(s) or metal cation(s) having more than one oxidation state above the ground state, excluding iron and nickel, complexed, bonded or associated with one or more bidentate or tridentate ligands;

(c) one or more metal(s) or metal cation(s) having more than one oxidation state above the ground state, excluding iron and nickel, complexed, bonded or associated with one or more anions and one or more ligands; or (d) mixtures thereof.

provided the anion and/or ligand does not itself render the metal cation inactive; i.e., renders the metal cation unable to change from one oxidation state above the ground state to another oxidation state above the ground state, decompose or cause polymerization of the metal salt, thereby rendering the metal cation inactive.

Examples of suitable copper anti-oxidants include copper dihydrocarbyl thio- or dithio-phosphates, copper polyisobutylene succinic anhydride and copper salts of carboxylic acid (naturally occurring or synthetic). Other suitable copper salts include copper dithiocarbamates, sulphonates, phenates, and acetylacetonates. Basic, neutral or acidic copper Cu(I) and/or Cu(II) salts derived from alkenyl succinic acids and anhydrides are known to be particularly useful.

While many and varied detergents and anti-oxidants have been recited above, this recitation is not intended as a limitation on the detergents or anti-oxidants but just as representative of materials which suitably can be employed in the present invention.

As previously indicated, the premix used in the present invention comprises a mixture of:

(a) one or more organic bases, preferably short chain polyamines;

(b) one or more detergents; and (c) one or more anti-oxidants.

In the premix the organic base, the anti-oxidant and the detergent are employed in a ratio of 0.5-10:0.5-10:2-80, preferably 1-4:1-4:4-40, more preferably 1:1:5, still more preferably 1:1:4.67.

In using the premix, the premix can be added to either the lubricating oil, the biodiesel fuel or to both the lubricating oil and the biodiesel fuel, preferably to the lubricating oil.

When added to the lubricating oil, the premix can be added in an amount in the range of 0.5 to 20 wt %, preferably 3 to 15 wt %, most preferably 10 to 15 wt %, based on the total weight of the formulated lubricating oil composition.

When added to the biodiesel fuel, the premix can be added in an amount in the range of 0.1 to 7 wt %, preferably 0.2 to 2 wt %, based on the total weight of the biodiesel fuel plus additives.

The premix can be made employing any order of addition of the components. The components are mixed neat, neat meaning that the components are mixed in the absence of the lubricating oil or biodiesel fuel into which they are eventually intended to be added. Two different premixing procedures can be used. It is not critical which procedure is used. Both procedures provide the desired "premix composition".

Step-Wise Addition and Heating/Mixing Procedure:

A first component, such as the anti-oxidant, can be weighed and added to a vessel and heated with stirring to a temperature in the range of 20° C. to 180° C., preferably 40° C. to 160° C., more preferably 60° C. to 90° C. and held at that temperature for from 30 to 500 minutes, preferably 30 to 200 minutes, more preferably 30 to 180 minutes. To this heated material can then be added a second component, e.g. the detergent or the organic base, with the resulting mixture being heated to a temperature in the aforesaid ranges and held at the temperature for a time in the aforesaid ranges. The final component is then added to the mixture, again with heating to a temperature in the aforesaid range with holding at that temperature for a time in the aforesaid range. Alternatively, two components can be added initially with heating to within the aforesaid range for a time in the aforesaid range, after which the third component is added with heating in the aforesaid range for a time in the aforesaid range.

All-In-One Addition and Heating/Mixing Procedure:

All three components are added to the vessel in any required sequence, preferably detergent, anti-oxidant, organic base, then the mixture is heated, with stirring, to a temperature in the aforesaid range and the mixture is held at the temperature, with mixing, for a time in the aforesaid range.

Following the premixing, the mixture is added in the desired amount to the lubricant, the biodiesel or both, preferably to the lubricant.

This premixing is conducted in the absence of any of the lubricating oil or the biodiesel fuel into which the additives are to be added. That is, the additives are combined either in their as-received form or as 100% active ingredient materials. Such additives are defined in this specification as being in the "neat form". Additives in the as-received form can be either 100% active ingredient or supplied by the manufacturer in a carrier fluid but are still considered "neat" for the purposes of this specification.

The mixture of neat additives when subject to the process of heating with stirring at a temperature in the aforesaid recited range for a time in the aforesaid recited range produces a product (a premix) that is believed to be an organic base/anti-oxidant/detergent complex. The complex is characterized by the existence of chemical or physical bonds or combinations of chemical and physical bonds between the components.

Such a complex is not produced when the components are simply added individually to a lubricating oil or biodiesel fuel and heated because of the solvent effect of the lubricating oil or biodiesel fuel which interferes with the formation of such chemical and/or physical bonds or linkages between the components.

Background Example 1

Four experiments were run to determine the ability of short chain polyamines to control oxidation of biodiesel fuel per se, and control the oxidation of lube base stock and formulated lubricating oil both with and without biodiesel fuel present in such base stock or formulated lubricating oil.

Biodiesel fuel used is identified as LAB SME which is a 21 mixture of methyl linoleate and methyl oleate and is representative of Soy Methyl Ester. This LAB SME sample is free of any added anti-oxidant and thus is truly representative of biodiesel. PAO-4 is used as representative of a lube base stock and a heavy duty commercial vehicle 15W40 formulated oil containing anti-oxidant, anti-wear additive, corrosion inhibitor, detergents, etc. present in amounts typical of a 15W40 HD commercial vehicle lubricating oil is used as representative of a formulated oil. Pressure Differential Scanning Colorimetry (PDSC) was used to measure oxidation stability as evidenced by an increase in oxidation onset temperature. The PDSC test is the CED L-85-T-90 test developed in Europe for ACEA E5 specification for heavy duty diesel oils. The test differentiates between base oils and between additives and is used to identify interaction between anti-oxidants and the results correlate with other oxidation tests. The tetra ethyl pentamine (TEPA) employed was 100% active ingredient. The results are presented below:

TABLE I

| | % SME | % PAO | % Formulated Oil | % TEPA | Oxidation Onset Temperature (° C.) |
|---|---|---|---|---|---|
| LAB SME | 100 | — | — | — | 154 |
| LAB SME | 97 | — | — | 3 | 184 |
| LAB SME | 90 | — | — | 10 | 206 |
| PAO | — | 100 | — | — | 192 |
| PAO | | 97 | — | 3 | 202 |
| PAO | | 90 | — | 10 | 218 |
| PAO | 10 | 90 | — | — | 183 |
| PAO | 10 | 89 | 0 | 1 | 207 |
| Formulated Oil | — | — | 100 | — | 268 |
| Formulated Oil | — | | 97 | 3 | 283 |
| Formulated Oil | — | | 90 | 10 | 294 |
| Formulated Oil | 10 | — | 90 | — | 247 |
| Formulated Oil | 10 | | 89 | 1 | 257 |

Example 1

Six samples of lab soy methyl ester (LSME) were evaluated for induction times: 1) alone; 2) with bisphenol anti-oxidant; 3) with tetraethyl pentamine (organic base); 4) with bisphenol anti-oxidant and tetraethyl pentamine added individually and separately; 5) with bisphenol anti-oxidant, tetraethyl pentamine and calcium salicylate detergent added individually and separately; and 6) with bisphenol anti-oxidant, tetraethyl pentamine and calcium salicylate added as a premix. All the additives used in this example were 100% active ingredient.

The results are presented below:

TABLE 2

| | Oxidation Induction Time |
|---|---|
| 1. LSME Biodiesel | <5 min. |
| 2. LSME + 0.75 wt % Bisphenol (Ethyl 702) | 50 min. |
| 3. LSME + 0.75 wt % TEPA | 37 min. |
| 4. LSME + 0.75 wt % Bisphenol (Ethyl 702) + 0.75 wt % TEPA | 109 min. |

TABLE 2-continued

| | Oxidation Induction Time |
|---|---|
| 5. LSME + 0.75 wt % Bisphenol (Ethyl 702) + 0.75 wt % TEPA + 3.5 wt % Calcium Salicylate (TBN = 64) | 184 min. |
| 6. LSME + Pre-mixed 0.75 wt % Bisphenol (Ethyl 702) + 0.75 wt % TEPA + 3.5 wt % Calcium Salicylate (TBN = 64) | >300 min. |

The premix of Experiment #6, Table 2 was prepared by adding the bis-phenol (ethyl 702), TEPA and Ca salicylate to a glass vial. The detergent was first weighed and added to the vial, followed by the anti-oxidant and finally the organic base. The mixture was heated to 85° C. and held at 85° C. with mixing for 120 minutes.

The "premix" prepared as described above was added to LSME. The LSME and premix was then subject to DSC experiment.

What is claimed is:

1. A method for improving the resistance to one or more of corrosion, oxidation, sludge and deposit formation of lubricating oil used to lubricate engines run on biodiesel fuel comprising adding to the lubricating oil an additive amount of a premix of one or more organic bases, one or more detergents and one or more anti-oxidants, wherein the premix is formed by weighing and adding either sequentially or simultaneously to a stirred heat vessel at 40 to 160 deg. C. the one or more organic bases, the one or more detergents and the one or more anti-oxidants, and mixing in said stirred heat vessel for a time from 30 to 500 minutes wherein the organic base is selected from nitrogen-containing bases of the formula:

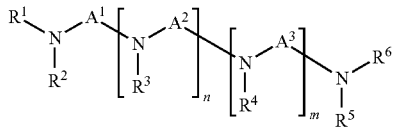

wherein $R^1$ to $R^6$ is a H, $C_1$ to $C_{30}$ alkyl group, $C_3$ to $C_8$ cycloalkyl group, $C_1$ to $C_{20}$ alkylcarboxyl group or $C_2$ to $C_8$ cyano-alkyl group, $A^1$ to $A^3$ are $C_2$ to $C_{12}$ alkylene group and/or $C_6$ to $C_{12}$ arylene group, and n and m are numbers ranging from 0 to 30;

II

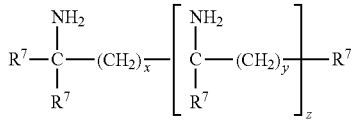

wherein $R^7$ are the same or different on each molecule and are selected from $C^1$ to $C^{10}$ alkyl, $C^s$ to $C^{10}$cycloalkyl, $C^7$ to $C^{10}$ aryl, $C^7$ to $C^{10}$ aryl alkyl, $C^7$ to $C^{10}$ alkylaryl and x is an integer from 0 to 20, y is an integer from 0 to 20 and z is an integer from 1 to 20;

III

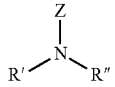

wherein R' and R" are the same or different $C_1$ to $C_{30}$ alkyl, $C_3$ to $C_{30}$ branched, $C_3$ to $C_{30}$ unsaturated alkyl, $C_6$ to $C_{30}$ aryl, $C_7$ to $C_{30}$ arylalkyl, $C_7$ to $C_{20}$ alkylaryl, $C_5$ to $C_{30}$ cycloalkyl or polycycloalkyl, $C_5$ to $C_{30}$ poly alkyl; and Z can be the following structure;

IV

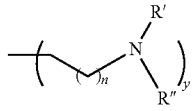

wherein N can be 1-6 and y can be 1-6 and mixtures thereof.

2. A method for improving the resistance to one or more of corrosion, oxidation, sludge and deposit formation of lubricating oil used to lubricate engines run on biodiesel fuel comprising adding to the biodiesel fuel an additive amount of a premix one or more organic bases, one or more detergents and one or more anti-oxidants, wherein the premix is formed by weighing and adding either sequentially or simultaneously to a stirred heat vessel at 40 to 160 deg. C. the one or more organic bases, the one or more detergents and the one or more anti-oxidants, and mixing in said stirred heat vessel for a time from 30 to 500 minutes wherein the organic base is selected from nitrogen-containing bases of the formula:

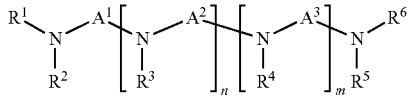

wherein $R^1$ to $R^6$ is a H. $C_1$ to $C_{30}$ alkyl group, $C_3$ to $C_8$ cycloalkyl group, $C_1$ to $C_{20}$ alkylcarboxyl group or $C_2$ to $C_8$ cyano-alkyl group, $A^1$ to $A^3$ are $C_2$ to $C_{12}$ alkylene group and/or $C_6$ to $C_{12}$ arylene group, and n and m are numbers ranging from 0 to 30;

II

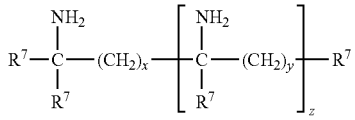

wherein $R^7$ are the same or different on each molecule and are selected from $C^1$ to $C^{10}$ alkyl, $C^s$ to $C^{10}$cycloalkyl, $C^7$ to $C^{10}$ aryl, $C^7$ to $C^{10}$ aryl alkyl, $C^7$ to $C^{10}$ alkylaryl and x is an integer from 0 to 20, y is an integer from 0 to 20 and z is an integer from 1 to 20;

III

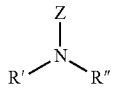

wherein R' and R" are the same or different $C_1$ to $C_{30}$ alkyl, $C_3$ to $C_{30}$ branched, $C_3$ to $C_{30}$ unsaturated alkyl, $C_6$ to $C_{30}$ aryl, $C_7$ to $C_{30}$ arylalkyl, $C_7$ to $C_{20}$ alkylaryl, $C_5$ to $C_{30}$ cycloalkyl or polycycloalkyl, $C_5$ to $C_{30}$ poly alkyl; and Z can be the following structure;

IV

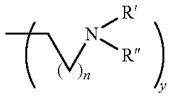

wherein N can be 1-6 and y can be 1-6 and mixtures thereof.

3. A method for improving the resistance to oxidation of biodiesel fuel by adding to the biodiesel fuel an additive amount of a premix of one or more organic bases, one or more detergents and one or more anti-oxidants, wherein the premix is formed by weighing and adding either sequentially or simultaneously to a stirred heat vessel at 40 to 160 deg. C. the one or more organic bases, the one or more detergents and the one or more anti-oxidants, and mixing in said stirred heat vessel for a time from 30 to 500 minutes wherein the organic base is selected from nitrogen-containing bases of the formula:

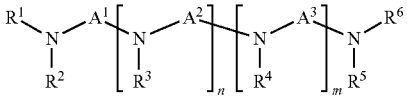

wherein $R^1$ to $R^6$ is a H. $C_1$ to $C_{30}$ alkyl group, $C_3$ to $C_8$ cycloalkyl group, $C_1$ to $C_{20}$ alkylcarboxyl group or $C_2$ to $C_8$ cyano-alkyl group, $A^1$ to $A^3$ are $C_2$ to $C_{12}$ alkylene group and/or $C_6$ to $C_{12}$ arylene group, and n and m are numbers ranging from 0 to 30;

II

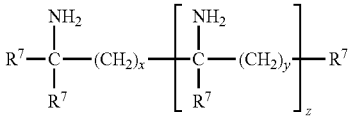

wherein $R^7$ are the same or different on each molecule and are selected from $C^1$ to $C^{10}$ alkyl, $C^s$ to $C^{10}$cycloalkyl, $C^7$ to $C^{10}$ aryl, $C^7$ to $C^{10}$ aryl alkyl, $C^7$ to $C^{10}$ alkylaryl and x is an integer from 0 to 20, y is an integer from 0 to 20 and z is an integer from 1 to 20;

III

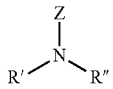

wherein R' and R" are the same or different $C_1$ to $C_{30}$ alkyl, $C_3$ to $C_{30}$ branched, $C_3$ to $C_{30}$ unsaturated alkyl, $C_6$ to $C_{30}$ aryl, $C_7$ to $C_{30}$ arylalkyl, $C_7$ to $C_{20}$ alkylaryl, $C_5$ to $C_{30}$ cycloalkyl or polycycloalkyl, $C_5$ to $C_{30}$ poly alkyl; and Z can be the following structure;

IV

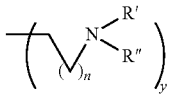

wherein N can be 1-6 and y can be 1-6 and mixtures thereof.

4. The method of claim 1, 2 or 3 wherein the detergent is selected from alkali, alkaline earth metal or hydrocarbyl-substituted salicylates, phenates, sulfonates, stearates, naphthanates, carboxylates and mixtures thereof.

5. The method of claim 1, 2 or 3 wherein the anti-oxidant is selected from one or more hindered phenolic anti-oxidants, hindered aminic anti-oxidants and oil-soluble metal complex anti-oxidants.

6. The method of claim 1, 2 or 3 wherein the premix contains the organic base, the anti-oxidant and the detergent in a weight ratio of 0.5-10:0.5-10:2-80.

7. The method of claim 1 or 2 wherein the premix contains the organic base, the anti-oxidant and the detergent in a weight ratio of 0.5-10:0.5-40:2-80.

8. The method of claim 4 wherein the premix contains the organic base, the anti-oxidant and the detergent in a weight ratio of 0.5-10:0.5-10:2-80.

9. The method of claim 5 wherein the premix contains the organic base, the anti-oxidant and the detergent in a weight ratio of 0.5-10:0.5-10:2-80.

10. The method of claim 1 wherein the premix is added to the lubricating oil in an amount in the range 0.5 to 20 wt % based on the total weight of the lubricating oil.

11. The method of claim 2 wherein the premix is added to the biodiesel fuel in an amount in the range 0.1 to 7 wt % based on the total weight of the biodiesel fuel plus additives.

12. The method of claim 3 wherein the premix is added to the biodiesel fuel in an amount in the range 0.1 to 7 wt % based on the total weight of the biodiesel fuel plus additive.

* * * * *